United States Patent [19]

Webster et al.

[11] 4,285,320

[45] Aug. 25, 1981

[54] VARIABLE CAPACITY FUEL DELIVERY SYSTEM FOR ENGINES

[76] Inventors: Sherwood F. Webster, 7832 Via Marina, Scottsdale, Ariz. 85258; Richard L. Heise, 133 E. Garfield, Tempe, Ariz. 85281

[21] Appl. No.: 98,033

[22] Filed: Nov. 28, 1979

Related U.S. Application Data

[63] Continuation-in-part of Ser. No. 950,470, Oct. 11, 1978, Pat. No. 4,187,820.

[51] Int. Cl.[3] ..... F02M 29/04

[52] U.S. Cl. ..... 123/593; 123/52 MF; 123/442; 123/445; 123/590; 261/78 R; 261/65; 48/180 P

[58] Field of Search ..... 123/590, 593, 52 MF, 123/442, 445; 261/78 R, 65; 48/180 R, 180 P, 180 B, 180 M, 180 C

[56] References Cited

U.S. PATENT DOCUMENTS

| | | | |
|---|---|---|---|
| 1,244,379 | 10/1917 | Short | 123/590 |
| 1,780,130 | 10/1930 | Heard | 261/78 R |
| 2,701,557 | 2/1955 | Ramey | 123/593 |
| 4,058,102 | 11/1977 | Fabritz | 123/590 |
| 4,099,503 | 7/1978 | Casey | 123/590 |
| 4,099,504 | 7/1978 | Bickhaus | 123/590 |
| 4,123,233 | 10/1978 | Mannino | 48/180 C |
| 4,180,042 | 12/1979 | Lloyd | 123/590 |

*Primary Examiner*—Ira S. Lazarus
*Attorney, Agent, or Firm*—B. P. Fishburne, Jr.

[57] ABSTRACT

A fuel atomizing valve and cooperative engine intake manifold are disclosed wherein the air volumetric capacity of the atomizing valve is infinitely varied automatically as a function of engine demand and without external controls. Intake manifold size and volumetric capacity are likewise varied automatically according to engine demand to assure delivery to all engine cylinders a cool dense homogeneous charge with superatomization of the fuel in a near molecular state.

14 Claims, 7 Drawing Figures

VARIABLE CAPACITY FUEL DELIVERY SYSTEM FOR ENGINES

CROSS-REFERENCE TO RELATED APPLICATIONS

This application is a continuation-in-part of prior copending application Ser. No. 950,470, filed Oct. 11, 1978 for INTAKE MANIFOLD VARIABLE ATOMIZING VALVE, now U.S. Pat. No. 4,187,820.

BACKGROUND OF THE INVENTION

The above prior patent application discloses a fuel atomizing valve for engines which are supplied with fuel and air through a carburetor whose primary function is to establish and maintain a proper air-fuel mixture ratio. In the prior application, the variable atomizing valve is supported on a mounting module arranged between the base of the carburetor and the customary carburetor mounting pad of the intake manifold. The valve projects through the main inlet opening of the manifold and into the manifold passage leading to the cylinders of the engine. The valve consists of a stationary sleeve surrounded by a coaxial telescoping relatively movable atomizing screen assembly which includes a rigid screen cage which holds and confines a pair of closely interfitting coaxial cylindrical screens, the interior one of which is of relatively coarse mesh, the outer screen being of much finer mesh construction. Guide bearing means provided between the screen assembly and the fixed sleeve establish an essential radial jump space across which the inducted air-fuel mixture is accelerated at the outlet end of the fixed sleeve in response to engine-created suction before impinging upon the atomizing screens. The movable screen assembly is yieldingly biased toward a nearly closed slow idle position relative to the fixed sleeve but extends itself automaticaly against the biasing means in response to engine demand to provide an infinitely variable atomized fuel delivery device directly into the intake manifold for all conditions of engine operation and demand.

While the atomizing valve according to the prior application operates with good efficiency to atomize fuel to a degree heretofore unattainable in the prior art and to deliver a homogeneous mixture of air and fuel into the intake manifold on demand, nevertheless, certain variables inherently present in piston engines exceeds the capability of the atomizing valve to respond completely to these variables particularly in terms of instantly deliverying the required volume of air under all conditions and in assuring the necessary intimate comingling and mixing of the air with fuel immediately prior to delivering the atomized charge into the manifold passage leading to the cylinders.

In view of the above, it is the object of this invention to substantially improve the variable atomizing valve of the above patent application so that it can satisfy automatically and immediately in response to engine demand all of the varying requirements for a superatomized homogeneous cool and dense fuel charge at each cylinder of an engine in the necessary volume for optimum engine operation at all speeds and under all power requirements encountered in normal operation. In essence, the present invention reacts automatically to engine demand without external control to deliver to the several cylinders the optimum fuel charge for greatest efficiency under all conditions encountered from slow idle through high speed high load operation. At any given engine demand situation, the fuel charge will contain the optimum volume of air and the always essential homogeneous mixture of air and fuel making up the combustible charge. Furthermore, the improved value and manifold arrangement will insure high velocity delivery of the charge through the manifold passage without the possibility of separation of the atomized fuel from the air during such delivery plus equality of charge volume, density and combustible quality at each cylinder under all conditions. The improved atomizing valve requires no additional moving components. As stated, it can respond to engine demand and alter its air volumetric capacity or air flow through effective size without external control. In accomplishing this, all of the desirable features of the atomizing valve according to the prior patent application are retained, including simplicity of construction, reliability and comparative low cost of manufacturing. The invention is entirely compatible with either carburetion fuel systems or fuel injection systems of the class in which raw fuel is directly injected into the center of the intake manifold upstream from the engine cylinders. The invention is also completely compatible with various piston engine configurations including four and six cylinder in-line engines which the automobile industry is turning to in the present-day energy crisis.

The heart of the improvement in the variable atomizing valve is the provision of a second exterior fixed sleeve in concentric surrounding relationship to the inner fixed sleeve. The movable screen assembly surrounds and telescopes over the exterior fixed sleeve and responds to engine demand generally in the manner set forth in the prior application.

A very important benefit derived from the use of the second exterior fixed sleeve is a substantial increase in the radial jump space for air and fuel as the latter change direction at the outlet ends of the fixed sleeves and begin to enter the main manifold passage after impinging upon and passing through the atomizing screens. This jump space in the improved valve is the full distance between the periphery of the interior fixed sleeve and the annular screen structure through which the accelerating fuel charge must pass to become superatomized. Because of the larger jump space, the velocity of the mixture impinging on the screen is supersonic, and this results in atomization of the fuel into particles of near molecular size with the atomized particles remaining at all times mixed with air in a homogeneous manner. In this important way, the results achieved with the invention are dramatically different from the prior art fuel delivery systems where unatomized fuel droplets are entrained in air entering conventional intake manifolds in a mixture of varying and changing density and continuity. As is well known, light vaporous fuel molecules ignite and burn readily in the engine whereas heavy molecules may fail to ignite or to burn completely, resulting in great losses of power, increased hydrocarbon pollutants in exhaust emissions and excessive carbon buildup, among many other known disadvantages.

In addition to the feature of increased jump space above discussed, the improved atomizing valve having the two concentrically spaced fixed sleeves insures complete and thorough intermixing of fuel and air into a nearly perfect homogeneous charge prior to its superatomization and in the critical zone between the carburetor or suitable injection means and points of entry into the manifold passage following passage of the mixture through the screens. In this connection, all of the supplied fuel under all engine demand conditions must enter and pass through the relatively confined passage provided by the interior sleeve, whereas air only under certain increased conditions of demand enters and passes through the annular space between the two fixed sleeves. Because of this unique arrangement there will always be proper thorough mixing of fuel and air within the bore of the inner fixed sleeve regardless of varying engine demand for a greater or lesser volume of the fuel charge. Under low demand conditions, all required air and fuel for optimum engine operation may be delivered through the interior fixed sleeve. As demand increases, some air and increasing volumes of air only are delivered through the annular space between the two fixed sleeves to satisfy engine requirements but without disturbing the mixing capability of the valve within the inner sleeve.

Another feature of the improved atomizing valve is the provision thereon of a fine conical screen across the top of the annular air only passage between the two fixed sleeves to divert or funnel all air into the interior sleeve passage for confined intermixing with fuel at low engine demand, such as idling. At such times, manifold suction is insufficient to force air through the conical screen and into the annular space between the two sleeves. However, as demand increases and suction in the manifold increases accordingly, additional air and air only will begin to be drawn through the conical screen to automatically increase the volumetric capacity of the valve, as air and fuel continue to pass without interruption through the interior sleeve. The necessary increase or decrease in fuel to meet changing conditions of demand is satisfied by state-of-the-art liquid fuel controls which, per se, are not a part of this invention.

In a second major aspect of the invention, the intake manifold of the engine is restructured to coact with the improved valve in a unique manner to satisfy engine demand most efficiently. Toward this end, the intake manifold has a divider plate between its top and bottom walls, preferably spaced from the top wall about one-third of the total distance between the two walls. The divider plate extends completely between the manifold side walls and is continuous from the main central inlet of the manifold receiving the valve to the individual cylinder fuel inlet ports. The divider plate defines two separated manifold passages, one of which is somewhat narrower than the other. Under low engine demand conditions, atomized fuel and air may be delivered by the valve into only the narrower passage with the wider passage completely blocked off. As demand increases, the second manifold passage gradually comes into play and is progressively uncovered. At maximum engine demand, both passages are active and receive the atomized charge from the valve. The arrangement insures that the atomized charge passes through the manifold at sufficient velocity and charge density and in a homogeneous state to enable optimum engine operation at all times.

Other features and advantages of the invention will become apparent to those skilled in the art during the course of the following detailed description.

DETAILED DESCRIPTION

Figure 1:
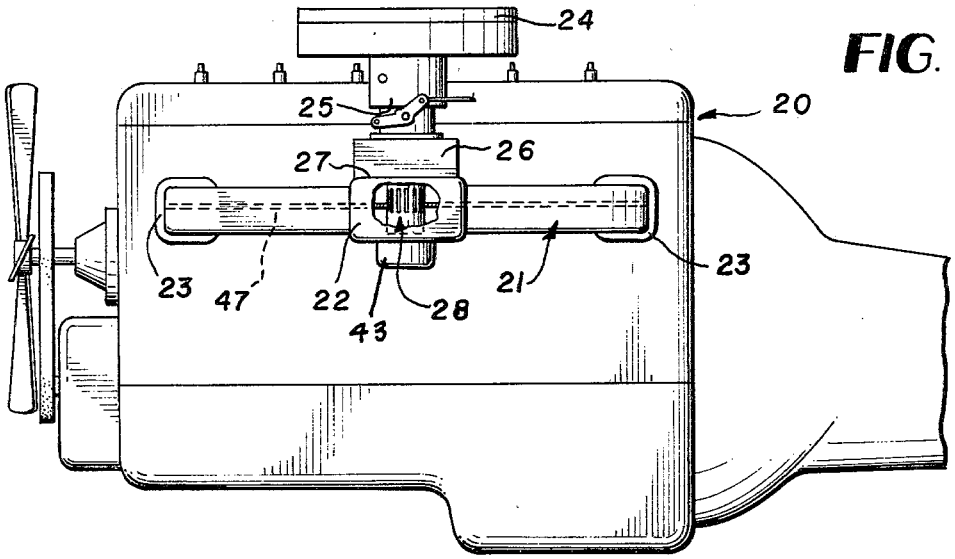
FIG. 1 is a side elevation of the invention installed on a piston engine equipped with a carburetor.
Figure 2:
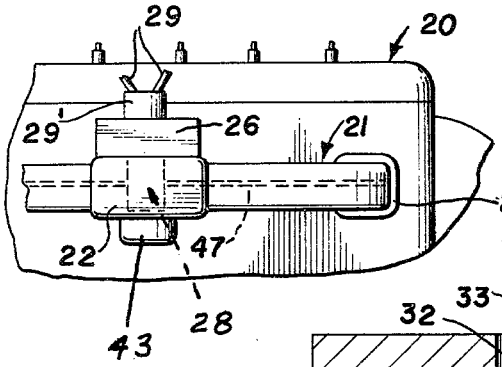
FIG. 2 is a fragmentary side elevation similar to FIG. 1 showing the invention on an engine having fuel injection means.
Figure 5:
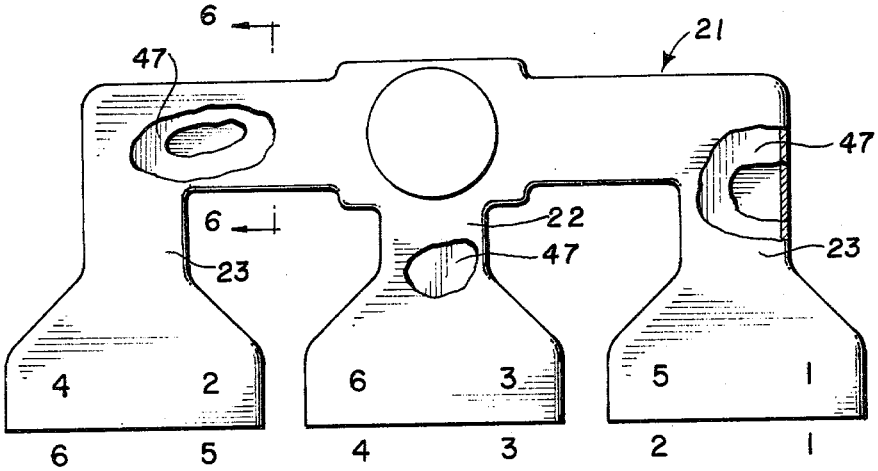
FIG. 5 is a plan view showing an intake manifold for a six cylinder in-line engine in accordance with the invention with the improved atomizing valve thereon.

Referring to the drawings in detail wherein like numerals designate like parts, there is shown in FIG. 1 a typical six cylinder in-line piston engine 20 equipped with an intake manifold 21 in accordance with the present invention. As best shown in FIG. 5, the six cylinders of the engine receive the fuel charge through a center manifold branch 22 and two end branches 23, the cylinders, not shown, being indicated by the consecutive numerals 1 through 6, and the ending cylinder firing order being indicated schematically by the non-consecutive numerals 1–5, 3–6 and 2–4 on the manifold branches.

The engine 20 further includes a customary air cleaner 24 and carburetor 25 of any conventional type. A mounting block or module 26 for the automatic atomizing valve according to the invention is placed between the carburetor base and the usual machined carburetor mounting pad 27 on the intake manifold.

Figure 3:
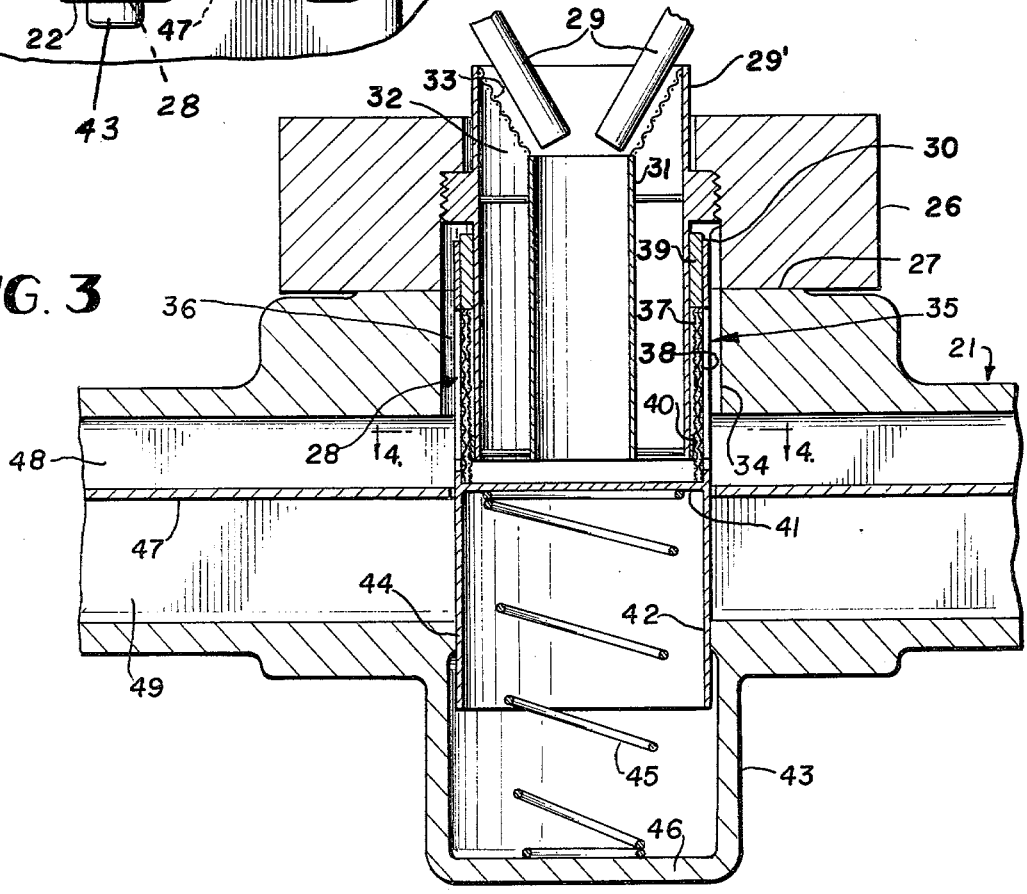
FIG. 3 is a central vertical section on an enlarged scale taken through the invention in accordance with FIG. 2.
Figure 4:
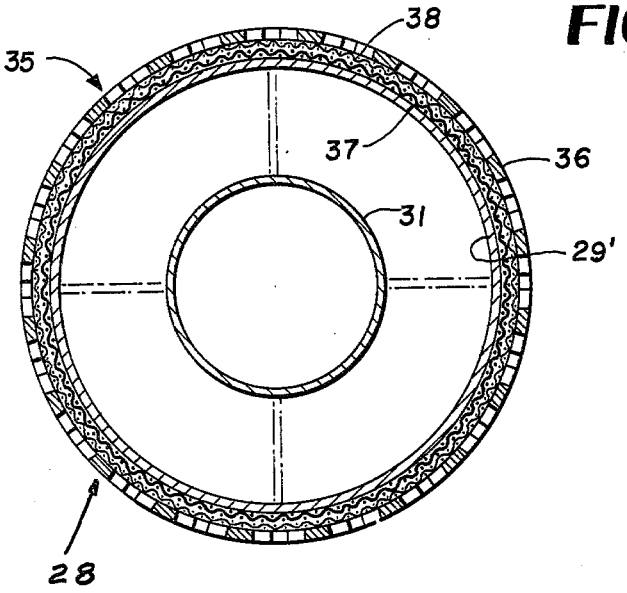
FIG. 4 is a horizontal section taken substantially on line 4—4 of FIG. 3.
Figure 6:
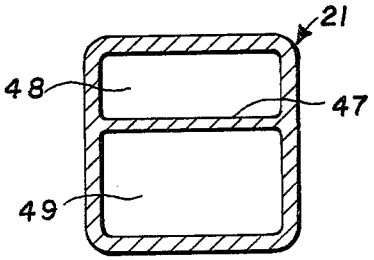
FIG. 6 is a vertical section through the manifold taken on line 6—6 of FIG. 5.
Figure 7:
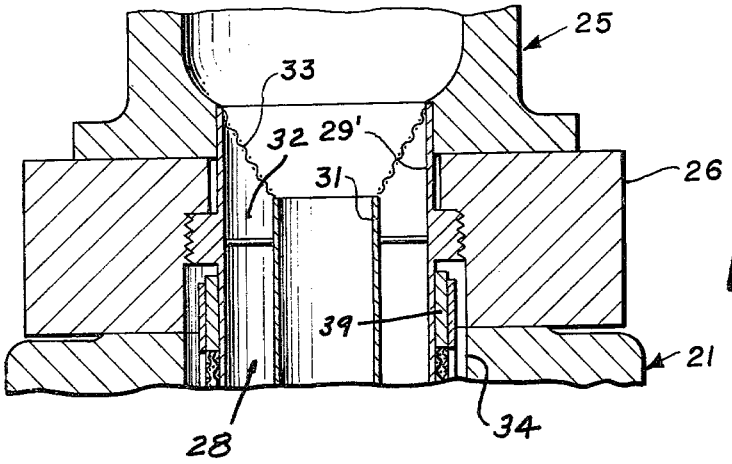
FIG. 7 is a fragmentary view similar to FIG. 3 showing the invention used with carburetion in accordance with FIG. 1

The improved automatic variable atomizing valve forming an important element of the invention is indicated by the numeral 28 in its entirety. This valve is shown in FIG. 3 of the drawings associated with fuel injection means 29 of the type employed to deliver liquid fuel to the main central inlet of an intake manifold according to one embodiment of the invention. The valve 28 is depicted in FIG. 7 in relationship to the base of the carburetor 25 shown in FIG. 1 in accordance with a second embodiment of the invention. The valve 28 per se may be substantially identical in either application or embodiment.

The valve comprises a fixed exterior cylindrical sleeve 29' held within a bore 30 of the mounting block 26, as shown. An interior fixed sleeve 31 of lesser diameter than the sleeve 29' is also held within the bore 30 of mounting block 26 in spaced concentric relationship to the outer sleeve 29'. The upper end of sleeve 29' extends above the upper end of sleeve 31 and the top of the annular space 32 between the two fixed sleeves is covered by a downwardly tapering fine mesh conical screen 33 which, during low demand periods of engine operation, such as idling, blocks combustion air at the top of the annular passage 32 and deflects or funnels the air into the smaller interior sleeve 31 along with the fuel from the injection means 29 or carburetor. Such fuel, as distinguished from air, is always directed into the inner fixed sleeve 31 and never into the passage 32 between the two sleeves 29' and 31, which is an air only passage receiving air in varying amounts as engine demand for air increases. At these times, increasing manifold suction will overcome the resistance offered by the screen 33, and the necessary additional air for optimum engine operation will be drawn through the screen 33 and passage 32 while fuel and air continue to be drawn through the interior sleeve 31.

The relatively confined passage provided by the smaller sleeve 31 insures at all times a very intimate comingling and mixing of air and fuel in the valve so that a homogeneous dense charge will always be delivered through the manifold to the engine cylinders, as previously discussed.

The lower ends of the two fixed sleeves terminate in alignment, as shown in FIG. 3, and the two sleeves project somewhat below the top wall of the manifold 21, as shown. The entire valve 28 is received within a main inlet opening 34 of the manifold at right angles to the main manifold passage.

The atomizing valve 28 further comprises an axially movable screen assembly 35 substantially in accordance with the construction of the screen assembly in the above-referenced patent application. This assembly includes an exterior longitudinally slotted essentially rigid screen cage 36 and two contained coaxial cylindrical atomizing screens 37 and 38 in contacting relationship. The two interfitting screens are of equal length axially. The interior screen 37 is of relatively coarser mesh than the exterior screen 38, as set forth in the prior patent application. The screen assembly 35 is telescopically mounted on the exterior sleeve 29' for restrained axial movement relative thereto in response to varying conditions of engine means, as previously discussed. Guide bearings 39 and 40 for the movable screen assembly are also provided, as described in the prior application.

The screen assembly cage 36 further includes a preferably flat bottom wall or closure 41 at the bottom ends of the two screens 37 and 38. Below the wall 41, the screen assembly further includes a cylindrical wall or skirt 42 extending entirely across the main manifold passage and beyond the far side of inlet opening 34 and into the bore of a cylindrical cup-like extension or well 43 formed on the bottom of the manifold 21 coaxially with the inlet 34. The well 43 preferably has a bearing surface 44 for the movable skirt 42 to guide it smoothly. As shown in FIG. 3, under conditions of minimal engine demand and hence minimal manifold vacuum, the screen assembly 35 including the attached skirt 44 are elevated in relation to the fixed sleeves 29' and 31. Such a condition would prevail at engine idle speeds. Only a very small annular area of the screens 37 and 38 are exposed at such time between the closure wall 41 and the lower ends of the fixed sleeves.

In accordance with the illustrated embodiments of the invention, the movable screen assembly 35 is yieldingly biased upwardly toward the illustrated idle position by a suitable compression spring 45 bearing on the wall 41 and the bottom wall 46 of the manifold well 43. When engine demand increases and vacuum in the manifold becomes stronger, the resulting downward fluid pressure on the wall 41 overcomes the resistance of spring 45 to suitably lower the screen assembly in relation to the sleeves 29' and 31 to satisfy engine demand by uncovering greater areas of the atomizing screens, as in the prior application structure.

The second main improvement feature of the invention discussed previously comprises providing in the intake manifold 21 a divider partition or plate 47 extending continuously from the main inlet 34 of the manifold through the manifold passage in the several branches 22 and 23 to the fuel charge inlet ports of the engine cylinders, not shown in the drawings but conventionally arranged in relation to the intake manifold branches. The divider plate 47 is continuous between the opposite side walls of the manifold and is parallel to the manifold top and bottom walls, and preferably about one-third of the distance down between the top and bottom walls so as to define two isolated manifold passages 48 and 49 throughout the entire manifold system. The upper passage 48, being considerably narrower in cross section than the lower larger passage 49, is suitable for delivering smaller fuel charge volumes to the cylinders at the necessary high velocity. As demand increases causing the screen assembly 35 to move downwardly, the skirt 42 will pass below the divider plate 47 and gradually uncover the passage 49 while an ever increasing area of the atomizing screens is exposed below the fixed sleeves 29' and 31. As this takes place, the active total cross sectional area of the maniofld increases as does the volume of the inducted fuel charge, due to additional air being drawn through the annular space 32, as previously described. As a net result of this, greater and greater volumes of the air-fuel mixture are delivered to the atomizing screens into both passages 48 and 49 of the manifold with the full velocity of the charge being maintained at all times. The operation of the total delivery system including the atomizing valve and the divided manifold insures that the homogeneous dense and cool fuel charge mixture will never separate inside of the manifold before reaching the engine cylinders and thus all of the main drawbacks of the prior art delivery systems are overcome by the invention. Under conditions of maximum engine demand for fuel and air, the skirt 42 will descend sufficiently to entirely uncover both manifold passages 48 and 49 and the atomizing screen assembly will be spanning the full cross section of the manifold and a superatomized homogeneous fuel charge at full velocity without separation and with no wetting of the manifold walls will be equally delivered to all cylinders.

Again, it should be stated and emphasized that the operation of the system does not require an external control, such as a microprocessor, and the engine itself delivers the necessary signal to the valve causing it to respond automatically with precisely the necessary gradient to satisfy the engine without diminishing operating efficiency at any demand condition. The atomizing valve is fully and automatically coordinated with the variable manifold passage through coaction of its skirt 42 with the divider wall 47 or plate, as described. In some instances, the plate 47 could be movably installed in the manifold 21 and yieldingly biased upwardly by spring means, not shown. In such cases, the divider plate 47 would gradually descend to increase or widen the manifold passage cross section responsive to engine demans for more fuel and air.

It should also be emphasized that a very important benefit is realized from the widened jump space created between the bottom of interior sleeve 31 and the wall defined by the two atomizing screens. The mixture will actually impact on the screens at supersonic speed due to being accelerated across the jump space. Superatomization to a near molecular particle state will result. At low engine demand or speed conditions, the velocity of the smaller volume atomized charge required to satisfy the demand will be increased by the smaller cross section of the upper passage 48 in the manifold. Full manifold suction is now diverted to the upper passage 48 due to the blockage of the lower passage 49 by skirt 42.

In conventional manifold systems, because of the large passage required to accommodate engine demand for maximum power, speed, acceleration or load, the system cannot react properly to diminish speed or demand and this causes undesirable separation of fuel from air in the charge. This separation is due to decreased velocity of the charge because the cross section of the manifold passage cannot change as with the present invention. The resulting manifold wetting due to fuel separation in the prior art destroys the correct balance of the air to fuel ratio.

Among the many important advantages achieved by the invention are the following:

1. Significantly increased mileage in automotive applications, as the result of a better atomized cold charge which increases the volumetric efficiency of the engine and promotes more complete combustion.

2. Pollutants in the engine exhaust are greatly reduced due to more complete and efficient combustion in every cylinder.

3. Engine performance is markedly improved including the absence of missing, difficult starting particularly when the engine is cold, and the elimination of dieseling or engine run-on. Improved performance is the result of superatomization of a cold air-fuel charge, homogeneous mixing under all conditions, and automatic response of the system to engine demand without waste of fuel by charge separation in the manifold, and consequently with no cylinder starvation.

4. In effect, the system increases the octane rating of a given fuel without chemical additives or lead. The improved valve creates an ideal uniform air-fuel mixture which causes air molecules to be intervened with fuel molecules in the atomized manifold charge. The intervening air acts in a manner similar to chemical additives or tetraethyl lead in retarding burning of the charge.

5. A lower grade of crude oil can be successfully utilized for making engine fuel with significant savings at the refinery on a comparative basis with prior art fuel delivery arrangements which necessitate a more expensive higher grade crude.

6. An engine utilizing this invention will idle smoothly at a much lower rpm than the usual 600–700 rpm at idle where state-of-the-art fuel delivery means are employed. A major reason for the greatly improved idle condition is the utilization of the varying cross section manifold, with about two-thirds of the manifold covered by the screen assembly skirt at idle.

While the improved variable atomizing valve has been disclosed in a free-floating arrangement within the manifold entrance, under the influence of a biasing spring, it should be understood that in some instances the movable screen assembly of the valve can be coupled with a control linkage for positive operation in various ways not shown in this application.

It is to be understood that the forms of the invention herewith shown and described are to be taken as preferred examples of the same, and that various changes in the shape, size and arrangement of parts may be resorted to, without deparating from the spirit of the invention or scope of the subjoined claims.

We claim:

1. A fuel delivery system for piston engines comprising an intake manifold having a manifold passage for delivering an air-fuel charge to cylinders of an engine from an external air-fuel source, a variable capacity engine demand responsive atomizing valve connected in the manifold passage and being in communication with said source, said valve including a biased atomizing screen assembly and coating fixed screen covering means whereby movement of the screen assembly against the biasing means in response to increasing engine demand causes a progressively greater atomizing screen area to be uncovered in the manifold passage, and a manifold passage variable closure means carried by the screen assembly and moving therewith and progressively increasing the effective cross section of the manifold passage as engine demand increases.

2. A fuel delivery system for piston engines as defined in claim 1, and said intake manifold having a central inlet intersecting said manifold passage, said atomizing valve projecting into said inlet with said biased atomizing screen assembly and manifold passage closure means moving through the inlet and across the manifold passage responsive to changes in engine demand, and a continuous longitudinal divider wall in the manifold passage extending from said inlet to the fuel inlet means of the engine cylinders, whereby when the screen assembly and manifold passage closure means are in a biased minimal engine demand position full manifold suction will exist in the manifold passage on one side only of said divider wall, the portion of the manifold passage on the other side of the divider wall being disabled by said variable closure means.

3. A fuel delivery system for piston engines as defined by claim 2, and said divider wall dividing the manifold passage into two unequal size passage portions, the passage portion of smaller size being actively utilized alone in minimal engine demand conditions and both manifold passage portions being actively utilized in conditions of maximal engine demand.

4. A fuel delivery system for piston engines as defined in claim 3, and said manifold passage variable closure means comprising a skirt extension on said screen assembly, and a cup-like extension on one side of the manifold adjacent to said central inlet and adapted to receive the skirt extension as the screen assembly and closure means move in one direction responsive to increasing engine demand.

5. A fuel delivery system for piston engines as defined in claim 4, and a biasing spring for said screen assembly in said cup-like extension and engaging a bottom wall of the screen assembly near the top of said skirt extension.

6. A fuel delivery system for piston engines as defined in claim 1, and said fixed screen covering means comprising a pair of fixed spaced concentric sleeves within the movable screen assembly and being supported on the manifold with the screen assembly engaging telescopically over the outermost fixed sleeve and spaced substantially from the innermost fixed sleeve to define a substantial radial jump space between the inner fixed sleeve and the atomizing screen wall of said assembly for greatly accelerating a fuel-air mixture being inducted into the manifold passage.

7. A fuel delivery system for piston engines as defined in claim 6, and the lower ends of said fixed concentric sleeves terminating at the same level in said manifold, the upper end of the outermost fixed sleeve extending above the corresponding end of the innermost fixed sleeve, and a conically tapering air funneling screen covering the top of an air only annular space between the fixed sleeves and serving to funnel air into the innermost fixed sleeve during conditions of low engine demand and then blocking the passage of air into said annular space, the conical screen allowing air only to enter said annular space during conditions of increased engine demand, and air and fuel continuing to pass through the innermost fixed sleeve under all conditions of engine demans, the comparative confined passage through the innermost fixed sleeve causing homogeneous mixing of air and fuel at all times during engine operation.

8. A fuel delivery system for piston engines as defined in claim 7, and means to inject fuel on demand into the confined passage of said innermost fixed sleeve along with air being continuously inducted through the innermost sleeve.

9. A fuel delivery system for piston engines comprising an intake manifold having a manifold passage for delivering an air-fuel charge to cylinders of an engine from an air-fuel source, and a variable capacity engine demand responsive atomizing valve connected in said manifold passage and being in communication with said source, said valve including a yieldingly biased atomizing screen assembly and a coating fixed screen covering means whereby movement of the screen assembly against the biasing means in response to increasing engine demand causes a progressively greater screen area to be uncovered in the manifold passage, said fixed screen covering means comprising a pair of fixed concentrically spaced sleeves within the screen assembly with the outermost fixed sleeve engaging telescopically in the screen assembly in close relationship thereto, the innermost sleeve being spaced substantially from the atomizing screen wall of the assembly to define a substantial jump space between the bore of the innermost fixed sleeve and said screen wall.

10. A fuel delivery system for piston engines as defined by claim 9, and corresponding ends of the fixed sleeves terminating in alignment in the manifold, the opposite end of the outermost fixed sleeve extending beyond the corresponding end of the innermost fixed sleeve, and a conical air blocking and funneling screen spanning the annular passage defined by the two fixed sleeves at the air inlet end of said passage.

11. A fuel delivery system for piston engines as defined by claim 9, and a manifold passage variable closure means carried by the screen assembly to progressively increase and decrease the active cross section of the manifold passage responsive to varying engine demand.

12. A fuel delivery system for piston engines as defined by claim 11, and said manifold passage variable closure means comprising an annular skirt on said screen assembly, the screen assembly having a cross wall at the top of said skirt for movement with the screen assembly toward and away from the opposing ends of said fixed sleeves.

13. A fuel delivery system for piston engines as defined by claim 12, and a biasing spring for said screen assembly interposed between it and an offset portion of said manifold.

14. A fuel delivery system for piston engines as defined by claim 9, and said source including fuel injection means for injecting fuel on demand into the innermost fixed sleeve only.

* * * * *